US007197783B2

(12) United States Patent
Wilson et al.

(10) Patent No.: US 7,197,783 B2
(45) Date of Patent: Apr. 3, 2007

(54) APPLIANCE HAVING A DRIVING MECHANISM

(75) Inventors: Matthew Charles Edward Wilson, Wells (GB); Simon Paul Wells, Workingham (GB); Geoffrey Michael Burlington, Edge (GB)

(73) Assignee: Dyson Technology Limited, Wiltshire (GB)

( * ) Notice: Subject to any disclaimer, the term of this patent is extended or adjusted under 35 U.S.C. 154(b) by 553 days.

(21) Appl. No.: 10/276,800

(22) PCT Filed: May 9, 2001

(86) PCT No.: PCT/GB01/01999

§ 371 (c)(1),
(2), (4) Date: Nov. 19, 2002

(87) PCT Pub. No.: WO01/88256

PCT Pub. Date: Nov. 22, 2001

(65) Prior Publication Data

US 2003/0167803 A1 Sep. 11, 2003

(51) Int. Cl.
*D06F 37/34* (2006.01)

(52) U.S. Cl. ..... 8/159; 68/58; 68/140

(58) Field of Classification Search ..... 68/24, 68/58, 140, 131, 133, 132; 8/158, 159
See application file for complete search history.

(56) References Cited

U.S. PATENT DOCUMENTS 2,209,980 A * 8/1940 Johnson ..... 475/308
2,343,742 A * 3/1944 Breckenridge ..... 68/23.1
2,396,749 A * 3/1946 Poff ..... 415/69

(Continued)

FOREIGN PATENT DOCUMENTS

FR 1448804 7/1966

(Continued)

OTHER PUBLICATIONS

International Search Report FOR PCT/GB01/01999, Oct. 2001, EPO.

(Continued)

*Primary Examiner*—Frankie L. Stinson
(74) *Attorney, Agent, or Firm*—Morrison & Foerster LLP

(57) ABSTRACT

An appliance having a driving mechanism is provided, the appliance (10) comprising two rotatable portions (32, 34) which are rotatable by the driving mechanism (50) about an axis (40). The driving mechanism (50) comprises a gearbox (60) having an input gear (116), two output gears (240, 304) and a locking mechanism (250, 252, 318) movable between a first position and a second position. The arrangement is such that, when the locking mechanism (250, 252, 318) is in the first position and the input gear (116) is driven, both output gears (240, 304) rotate in the same direction and, when the locking mechanism (250, 252, 318) is in the second position and the input gear (116) is driven, the output gears (240, 304) rotate in opposite directions. The arrangement of the axis (40) is horizontal or substantially horizontal. The invention is particularly suitable for use in a front-loading washing machine (10) having a drum (30) comprising two rotatable portions (32, 34). The driving mechanism (50) can be used to selectively cause rotation of the rotatable portions (32, 34) either in the same direction or in opposite directions.

32 Claims, 13 Drawing Sheets

U.S. PATENT DOCUMENTS

| | | | | | |
|---|---|---|---|---|---|
| 2,399,319 | A | | 4/1946 | Bowen | |
| 2,484,921 | A | * | 10/1949 | Wolff, Jr. | 475/282 |
| 2,561,090 | A | * | 7/1951 | Baumann | 60/718 |
| 2,637,186 | A | * | 5/1953 | Pavton | 68/23.4 |
| 2,668,459 | A | * | 2/1954 | Berklege | 475/254 |
| 2,682,789 | A | * | 7/1954 | Ochtman | 475/265 |
| 2,771,794 | A | * | 11/1956 | Shenk et al. | 475/139 |
| 2,836,046 | A | * | 5/1958 | Smith | 68/23.2 |
| 2,839,952 | A | * | 6/1958 | Ondeck | 475/188 |
| 2,895,320 | A | * | 7/1959 | Long | 68/58 |
| 2,958,239 | A | * | 11/1960 | Bernier | 475/327 |
| 2,995,023 | A | * | 8/1961 | Peyton | 68/131 |
| 3,182,529 | A | * | 5/1965 | Schwerdhofer | 475/294 |
| 3,306,133 | A | * | 2/1967 | Hans et al. | 475/149 |
| 3,339,530 | A | * | 9/1967 | Gillette | 119/56.2 |
| 3,342,085 | A | * | 9/1967 | Brundage | 475/169 |
| 3,394,609 | A | * | 7/1968 | Herring | 74/330 |
| 3,478,622 | A | * | 11/1969 | Reid | 475/298 |
| 4,020,659 | A | * | 5/1977 | Bhavsar | 68/27 |
| 4,509,390 | A | * | 4/1985 | Hockmuth | 475/339 |
| 4,584,732 | A | * | 4/1986 | Kohsaka | 8/159 |
| 4,910,979 | A | * | 3/1990 | Burk et al. | 68/23.7 |
| 4,964,315 | A | | 10/1990 | Willis, Jr. | |
| 5,000,016 | A | | 3/1991 | Burk et al. | |
| 5,211,039 | A | * | 5/1993 | Pellerin | 68/27 |
| 5,322,488 | A | * | 6/1994 | Ra et al. | 475/330 |
| 5,326,334 | A | * | 7/1994 | Ra et al. | 475/330 |
| 5,330,395 | A | * | 7/1994 | Ra et al. | 475/330 |
| 5,364,320 | A | * | 11/1994 | Ra et al. | 475/280 |
| 5,394,764 | A | * | 3/1995 | Fini, Jr. | 74/378 |
| 6,112,863 | A | * | 9/2000 | Colletti | 188/77 R |
| 6,513,737 | B2 | * | 2/2003 | Ivanov et al. | 241/23 |

FOREIGN PATENT DOCUMENTS

| | | | |
|---|---|---|---|
| GB | 538594 | | 8/1941 |
| GB | 678186 | | 8/1952 |
| GB | 2 202 867 | A | 4/1967 |
| JP | 64-49599 | * | 2/1989 |
| JP | 10-33886 | | 2/1998 |
| WO | 99/58753 | | 11/1999 |

OTHER PUBLICATIONS

British Search Report For GB 0011992.5, Sep. 2000, United Kingdom Patent Office.

* cited by examiner

APPLIANCE HAVING A DRIVING MECHANISM

The invention relates to an appliance having a driving mechanism. The invention relates particularly, but not exclusively, to a domestic appliance, for example a washing machine, having a driving mechanism. The invention also relates to a method of operating such an appliance.

Driving mechanisms for use in appliances in general are well known. Furthermore, such driving mechanisms in the form of planetary or epicyclic gears are well known and are commonly used to drive rotating bodies when it is desired periodically to reverse the direction of the output rotation. Under such circumstances, the configuration of the epicyclic gear is altered so that, for a given direction of input rotation, the direction of the output rotation can be selected.

It has been proposed in WO 99/58753 to provide a domestic appliance in the form of a washing machine which incorporates a drum having two rotatable portions and drive means for rotating the rotatable portions so that relative rotation between the rotatable portions can be achieved. In one embodiment, the two rotatable portions of the drum are rotatable at substantially the same speed in opposite directions for at least part of the period of operation of the washing machine. This arrangement causes increased agitation to the articles contained within the washing machine during the washing portion of the operating cycle. However, the rotatable portions of the drum are then also required to rotate at the same speed and in the same direction in order adequately to spin rinse water out of the articles during the spinning portion of the operating cycle. In order to achieve this, each drum has been provided with a separate drive mechanism so that each drum can be rotated at the required speed and in the required direction at the appropriate time in the operating cycle. Control means are then required to ensure that each drive mechanism operates correctly during each part of the operating cycle. Also, two separate motors are required which adds to the cost of the appliance and also to the volume of components which need to be housed within a fixed space.

U.S. Pat. Nos. 4,910,979 and 5,000,016 each disclose a vertical-axis washing machine having a tub, a basket in which articles to be washed are received, and a central agitator located inside the basket. The basket and the agitator are each freely rotatable, in an oscillating manner, with respect to the tub. The driving mechanism which causes the basket and agitator to oscillate is an epicyclic arrangement by means of which, when the agitator is driven through a given angle in a first direction about the vertical axis, the basket rotates, albeit through a smaller angle of rotation, in the opposite direction. The angle of rotation of the basket is dependent upon many factors, including the system inertia, the angle of the agitator stroke and the size of the load in the washing machine. Such an arrangement is not suitable for use in horizontal-axis washing machines primarily because the washing action in a horizontal-axis machine is very different from that in a vertical-axis machine.

An object of the invention is to provide an appliance having a driving mechanism which is suitable for use in a horizontal axis washing machine. A further object of the invention is to provide an appliance having a driving mechanism which can be used to drive two rotatable portions of the drum of a horizontal-axis washing machine. Another object of the invention is to provide a horizontal-axis washing machine in which the number of drive motors required to be used is reduced. A still further object of the present invention is to provide an appliance of the type described above in which the cost of manufacture is reduced and/or in which the number of drive motors required is reduced.

The invention provides an appliance comprising two rotatable portions and a driving mechanism for rotating the rotatable portions about an axis, the driving mechanism comprising a gearbox having an input gear, two output gears connected to the rotatable portions and a locking mechanism movable between a first position and a second position, the arrangement being such that, when the locking mechanism is in the first position and the input gear is driven, both output gears rotate in the same direction and, when the locking mechanism is in the second position and the input gear is driven, the output gears rotate in opposite directions, characterized in that the axis is arranged horizontally or substantially horizontally.

The arrangement according to the invention allows an appliance having two portions rotatable about a horizontal axis to be provided with a single drive mechanism having a single input gear but having two output gears. By means of the locking mechanism, the output gears can be selected to rotate either in the same direction when they are required to do so (eg. during delicate washing portions and spinning portions of an operating cycle in a washing machine) or in opposite directions when they are required to do so (eg. during normal or "heavy soil" washing portions of an operating cycle in a washing machine). Only a single drive motor is then required to be connected to the input gear, with no additional drive motors being required to achieve either synchronised rotation or counter rotation during the relevant portions of the operating cycle. (It will be understood that an arrangement of more than one drive motor operating in series can be provided to drive the input gear without departing from the scope of the present invention.) This means that the number of motors required to achieve the required manner of operation is reduced which, in turn, leads to a reduction in the number of bulky components requiring to be housed within the casing of the appliance and a reduction in the cost of the appliance.

It is preferred that the output gears are arranged coaxially and that the input gear is coaxial with the output gears. In a preferred embodiment, each output gear is connected to a shaft and the shafts are arranged coaxially, one inside the other. These features provide a compact and efficient arrangement which is suitable for use in a horizontal-axis washing machine in which the drum portions are supported in a cantilever fashion to allow the provision of a front-opening door.

Preferably, the arrangement is such that, when the locking mechanism is in the first position and the input gear is driven, both output gears rotate in the same direction and at the same speed. More preferably, when the locking mechanism is in the second position and the input gear is driven, the output gears rotate in opposite directions at substantially the same speed. This arrangement is particularly suitable for use in a washing machine of the type described in WO 99/58753, because the operating cycle of the washing machine requires the drum portions to rotate in the same direction and at the same speed for some of the time and in opposite directions at substantially the same speed for some of the time.

In a preferred embodiment, the gearbox comprises a gear with a planetary arrangement and having an annulus, a plurality of planet wheels carried on a planet carrier, and two sun wheels. It is preferred that, when the locking mechanism is in the first position, the locking mechanism engages both the planet carrier and the annulus so as to prevent relative rotation therebetween. More preferably, the locking mechanism and the annulus each carry a plurality of projections, the projections carried by the locking mechanism interengaging with the projections carried by the annulus when the locking mechanism is in the first position. Even more preferably, the locking mechanism is mounted on the planet carrier.

The arrangement thus provided is compact and relatively easy to incorporate into an appliance of the type described in WO 99/58753. The operation of the locking mechanism is also reliable and not greatly prone to failure, as is required in the envisaged application of a washing machine.

The driving mechanism preferably incorporates an actuator for moving a locking plate of the locking mechanism from a first position to a second position. The actuator preferably comprises a first actuator ring and a second actuator ring, the first actuator ring being attached to a fixed portion of the appliance in a manner which allows rotation thereof about an axis of the gearbox and having inclined surfaces facing the second actuator ring, the second actuator ring being engaged with the fixed portion of the appliance in a manner which allows movement thereof parallel to the axis of the gearbox and having inclined surfaces facing the first actuator ring and complimentary to the inclined surfaces of the first actuator ring, such that rotational movement of the first actuator ring causes movement of the second actuator ring parallel to the axis of the gearbox as a result of the movement of the inclined surfaces across one another.

This arrangement allows the driving mechanism to be converted between synchronised rotation and counter rotation simply by rotation of the first actuator ring about an axis of the gearbox. The rotation of the first actuator ring can be achieved simply and effectively using known techniques.

The invention further provides a method of operating an appliance of the type described above, the method comprising the steps of:

(a) driving the input gear with the locking mechanism in the first position so as to cause the output gears to rotate in the same direction;

(b) causing the locking mechanism to move from the first position to the second position; and (c) driving the input gear with the locking mechanism in the second position so as to cause the output gears to rotate in opposite directions.

Preferably, during step (c), the output gears rotate in opposite directions at substantially the same rotational speed. Such a method is highly suitable for operating a washing machine of the type described in WO 99/58753.

An embodiment of the invention will now be described, by way of example only, with reference to the accompanying drawings, in which.

Figure 2:
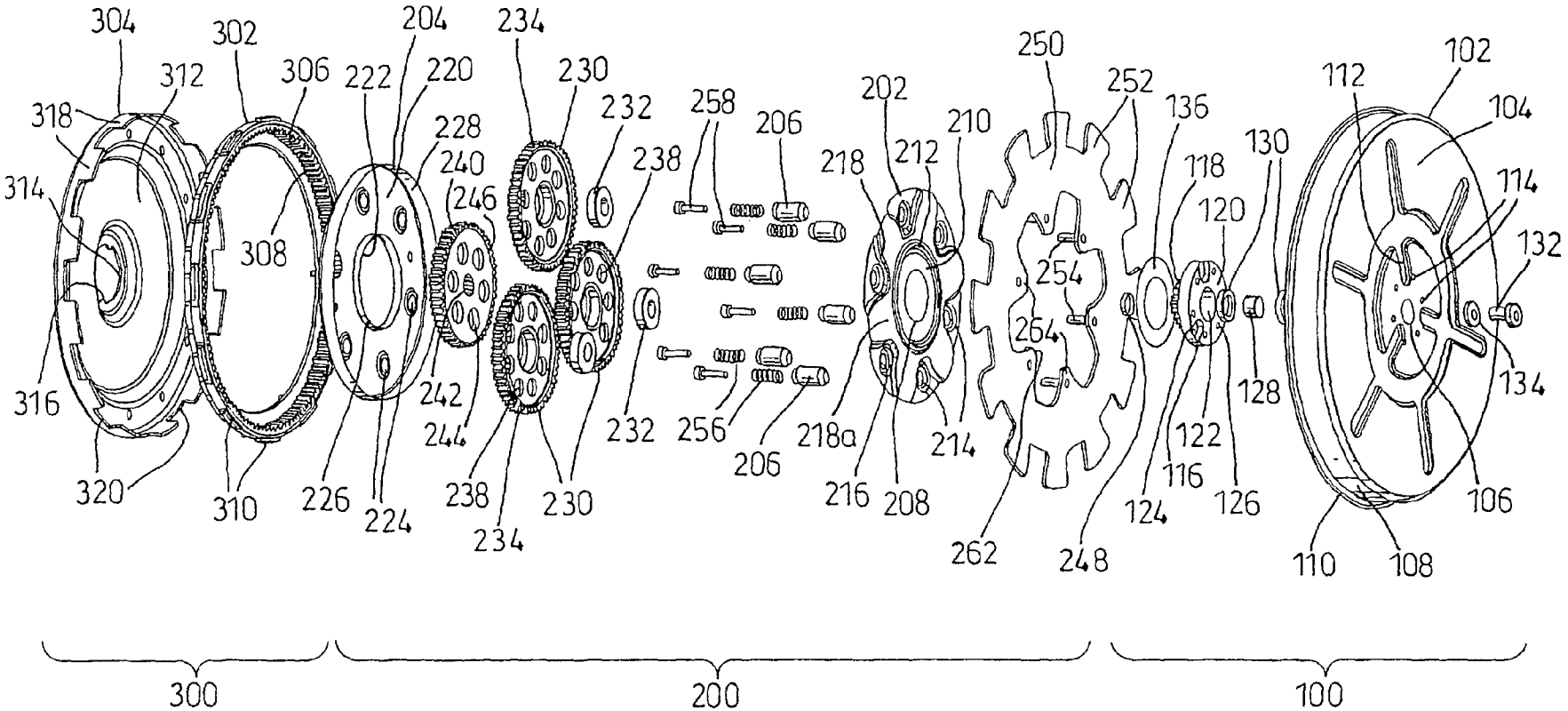
FIG. 2 is an exploded view of a gearbox forming part of the driving mechanism incorporated into the washing machine shown in FIG. 1.
Figure 3A:
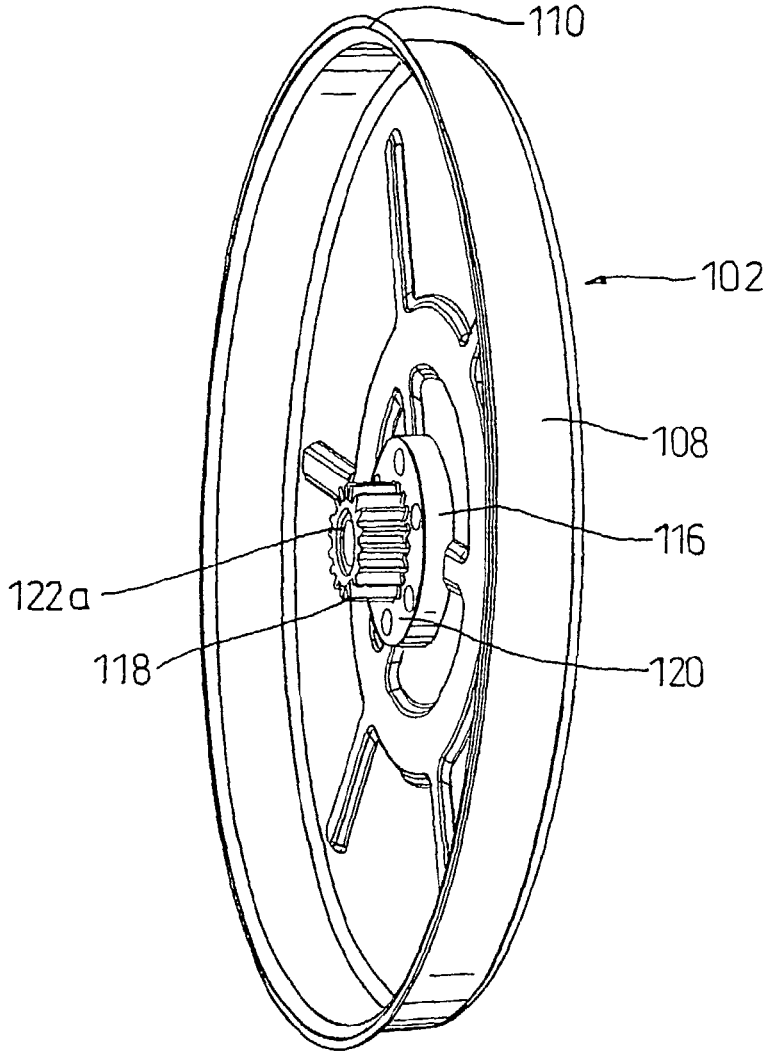
Figure 3B:
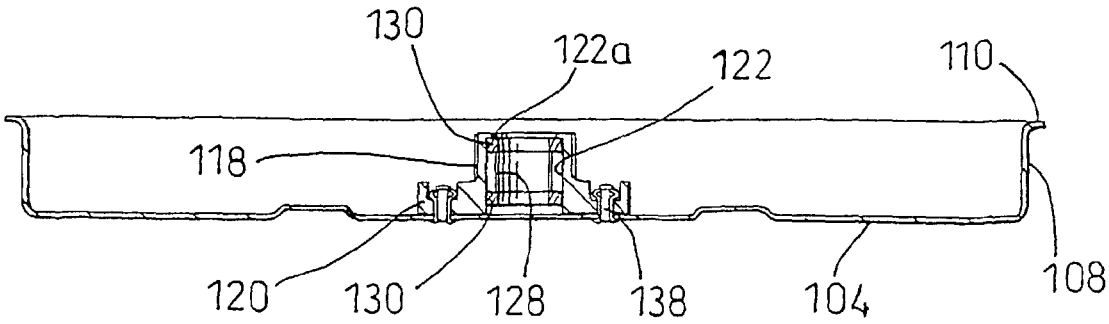

FIG. 3*a* is a perspective view of a first group of the components shown in FIG. 2 in an assembled form;

FIG. 3*b* is a sectional view through the first group of components of FIG. 3*a;*

Figure 4:
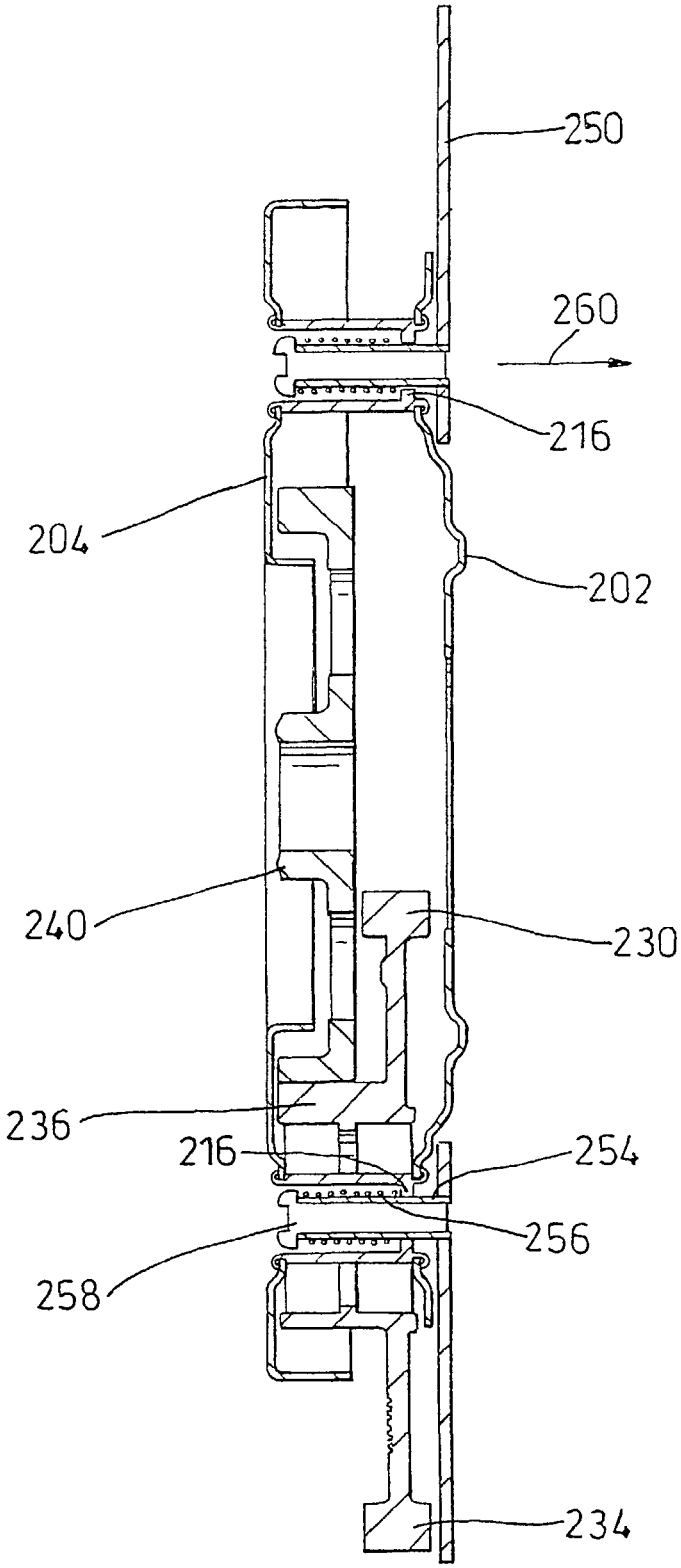
Figure 5:
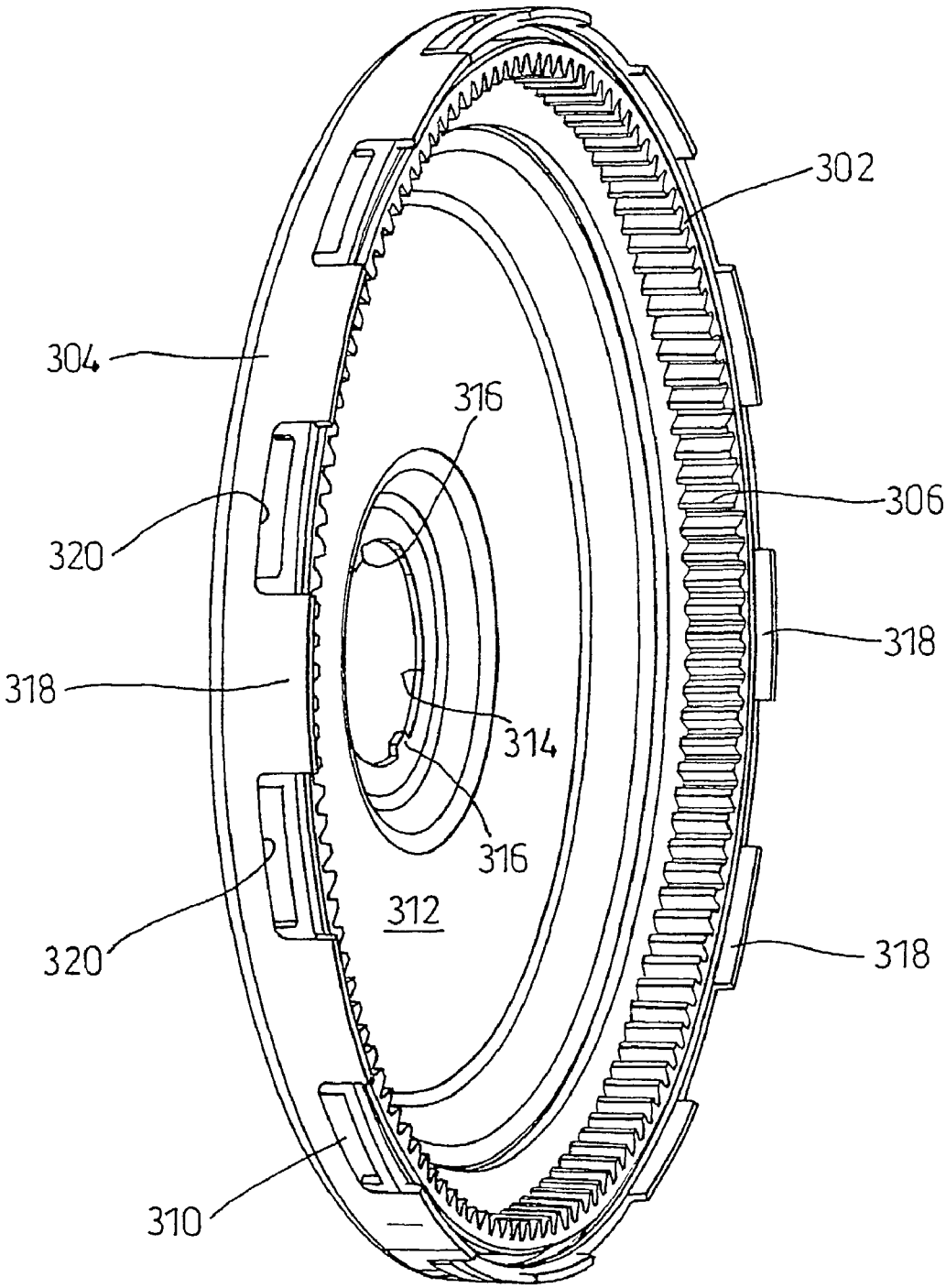
Figure 6A:
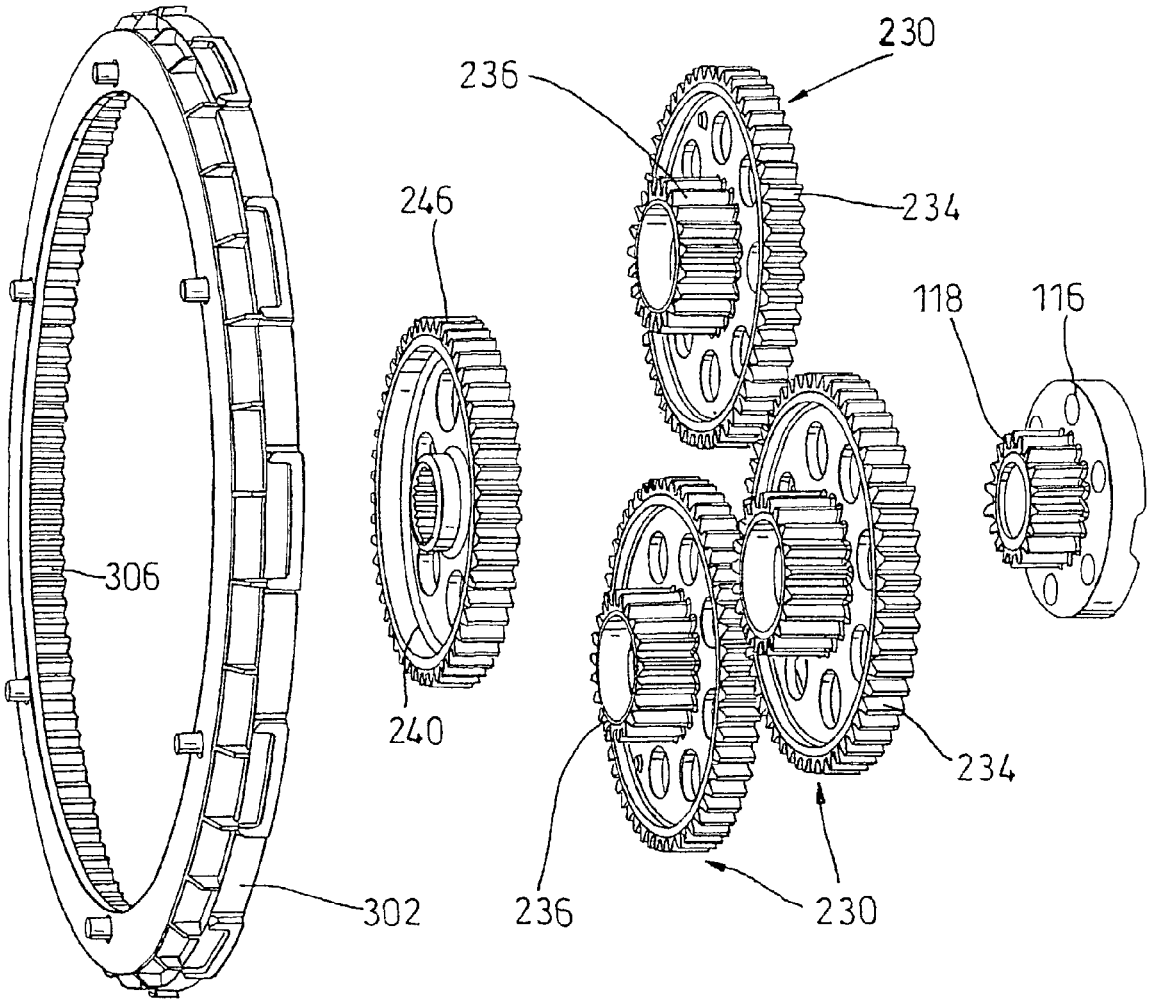
Figure 6B:
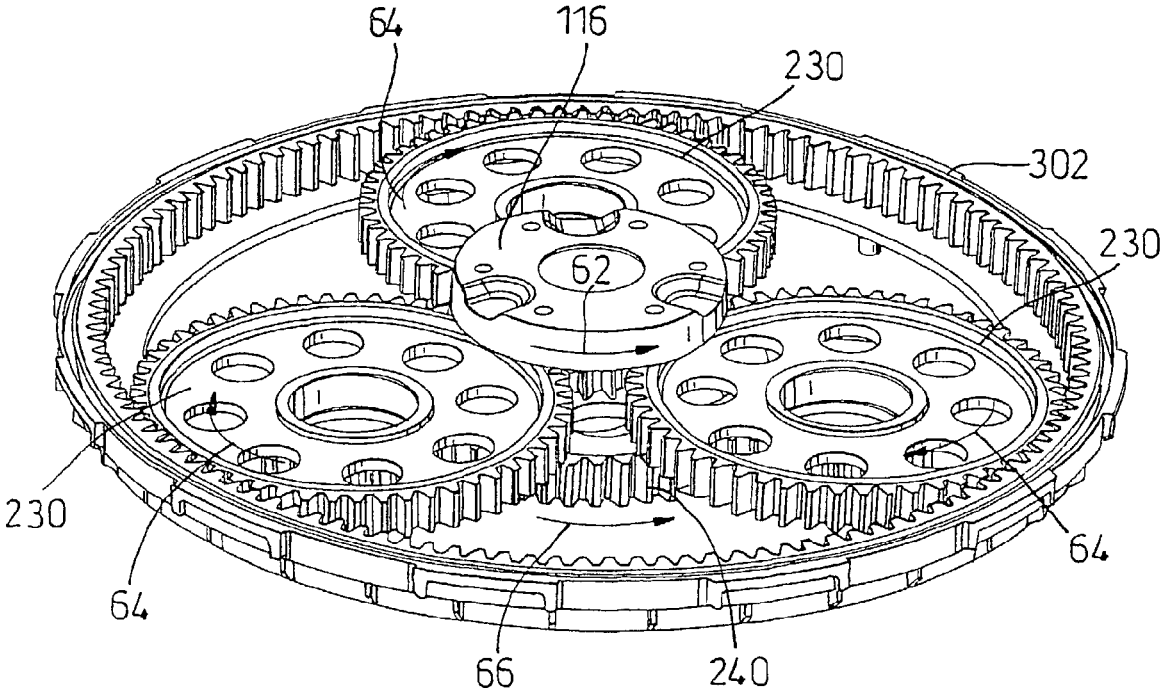
Figure 6C:
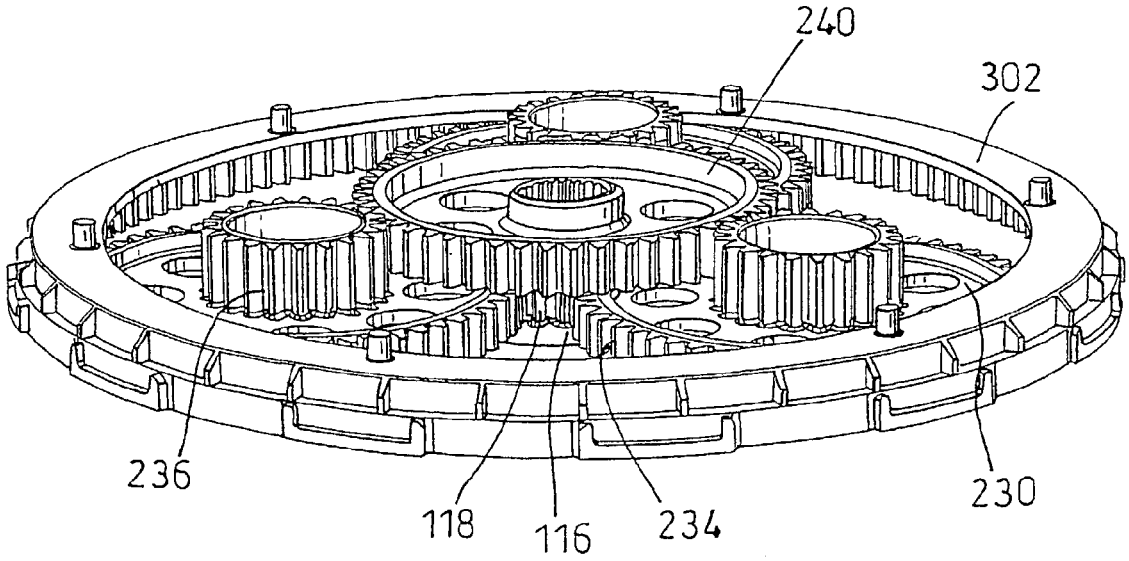

FIG. 4 is a sectional view through a second group of the components shown in FIG. 2 in an assembled form;

FIG. 5 is a perspective view of a third group of the components shown in FIG. 2 in an assembled form;

FIG. 6*a* is an exploded view of several of the components shown in FIG. 2 and forming the working parts of the gearbox;

FIG. 6*b* is a first perspective view of the components of FIG. 6*a* in assembled form and illustrating the action of the gearbox;

FIG. 6*c* is a second perspective view of the components of FIG. 6*b;*

Figure 1:
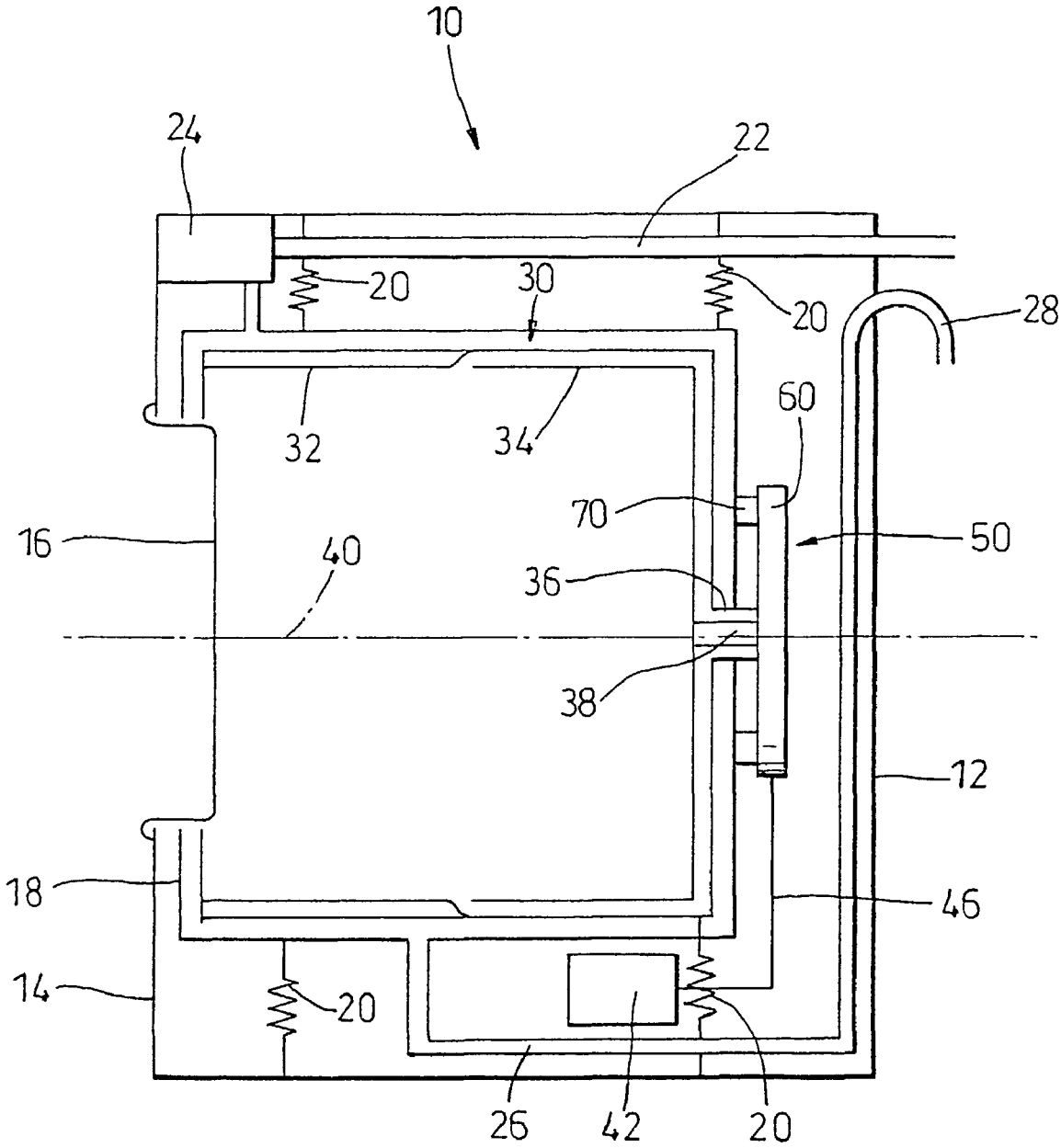
FIG. 1 is a schematic side view of an appliance, being a washing machine, having a driving mechanism and according to the invention.
Figure 7:
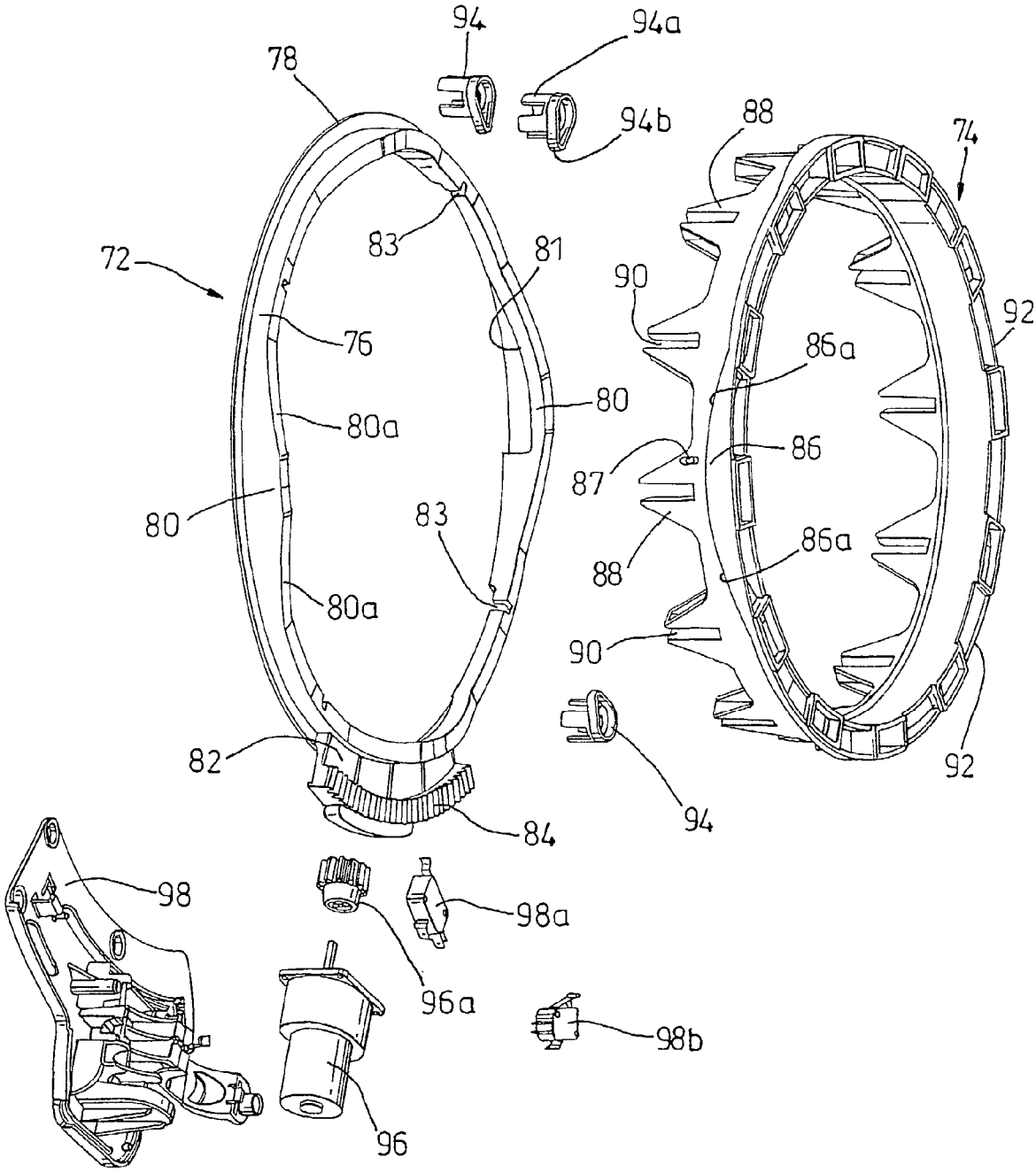
Figure 8:
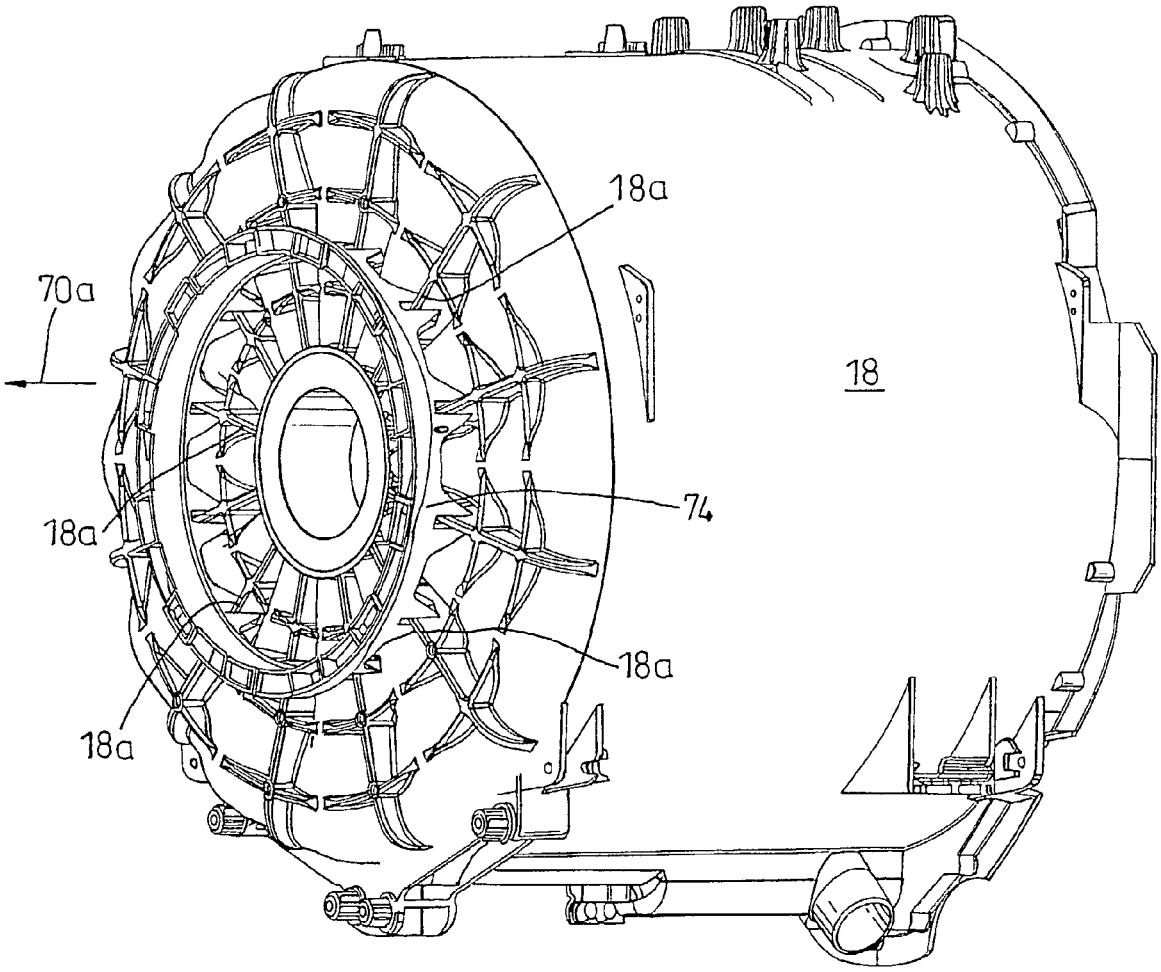
Figure 9A:
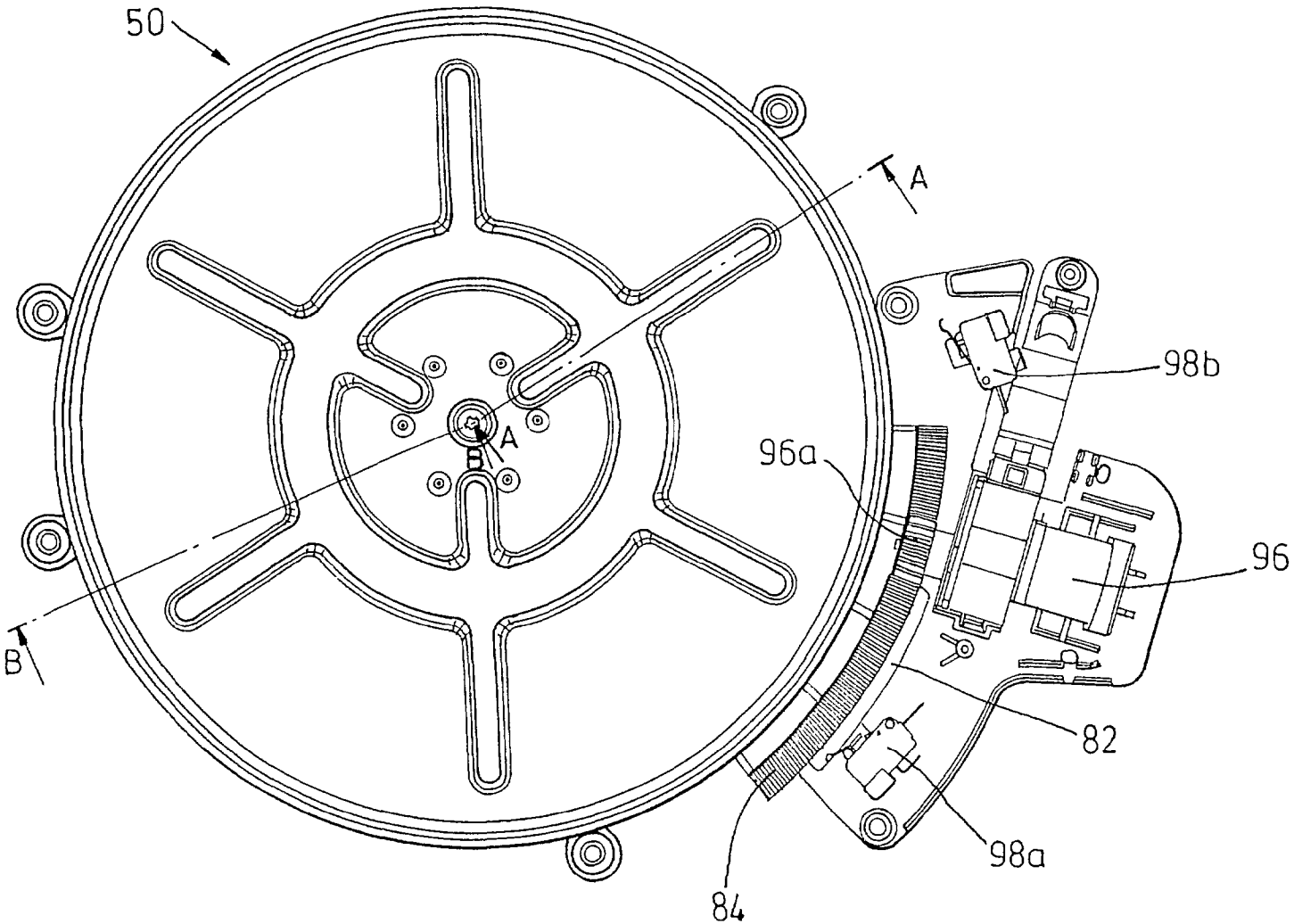
Figure 9B:
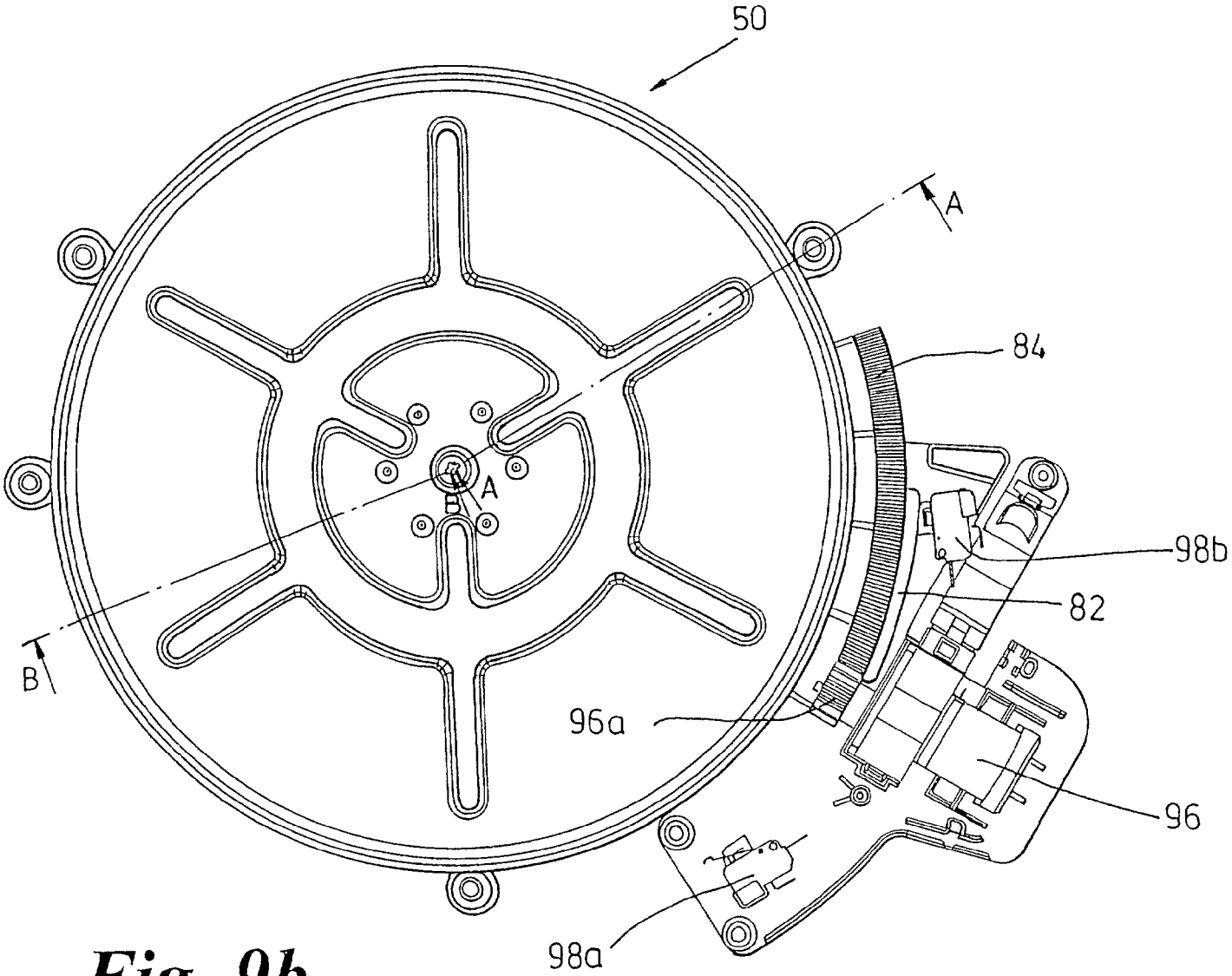
Figure 10A:
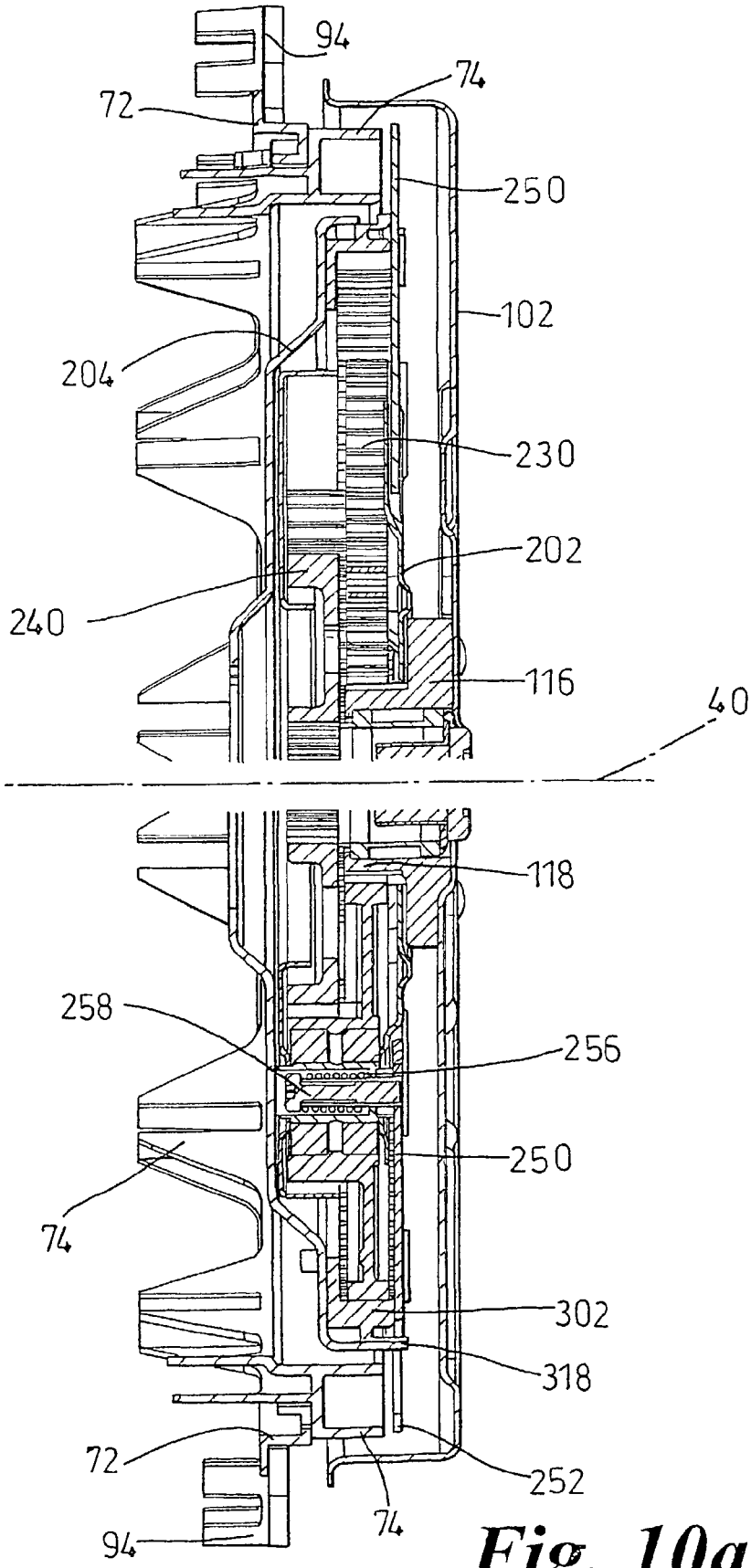
Figure 10B:
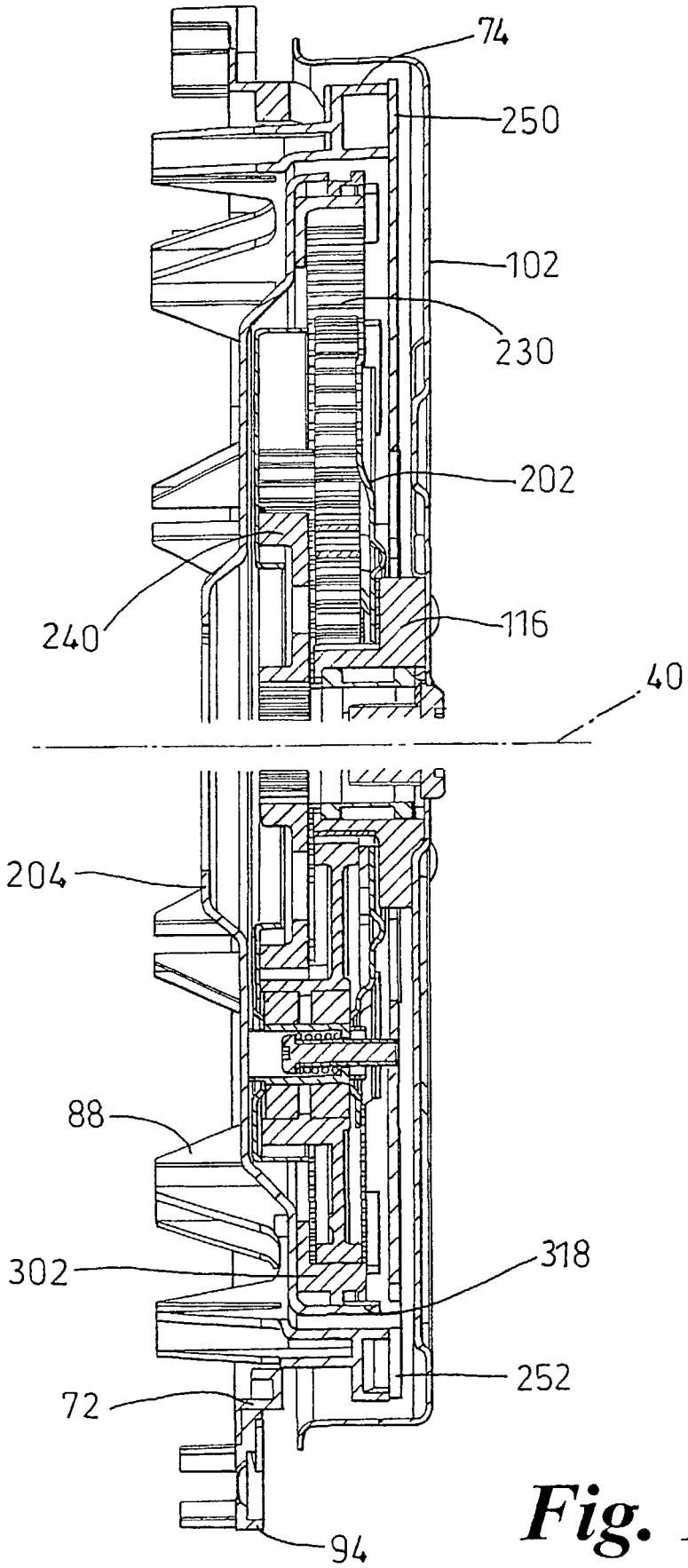

FIG. 7 is an exploded view of an actuator forming part of the driving mechanism incorporated into the washing machine shown in FIG. 1;

FIG. 8 is a perspective view of the rear of a tub forming part of the washing machine of FIG. 1 with part of the actuator of FIG. 7 attached thereto;

FIG. 9*a* is a schematic plan view of the rear of the tub and part of the actuator showing the position thereof when synchronized rotation of the drum portions is required;

FIG. 9*b* is a schematic plan view of the rear of the tub and part of the actuator showing the position thereof when counter rotation of the drum portions is required;

FIG. 10*a* is a cross-section through the gearbox and actuator during synchronized rotation of the drum portions; and FIG. 10*b* is a cross-section through the gearbox and actuator during counter rotation of the drum portions.

In the embodiment illustrated in the drawings, the invention is embodied in a domestic washing machine having a driving mechanism. Such a washing machine is illustrated, schematically, in side view in FIG. 1. The washing machine 10 has an outer casing 12 having a front panel 14 in which is located a door 16. A water-tight tub 18 is mounted inside the casing 12 in a known manner by a spring damper mechanism 20. A water inlet conduit 22 communicates with an upper portion of the tub 18 via a soap tray 24. A water drainage conduit 26 communicates with a lower portion of the tub 18 and also with a drainage outlet 28. Appropriate pumps and valves (not shown) are provided for controlling the inlet and drainage of water to and from the tub 18. The components described thus far are all well known in the art and form no part of the present invention.

Mounted inside the tub 18 is a drum 30 consisting of a first rotatable portion 32 and a second rotatable portion 34. The first rotatable portion 32 is mounted in cantilever fashion on a first shaft 36 and the second rotatable portion 34 is mounted coaxially with the first rotatable portion on a second shaft 38. As shown in FIG. 1, the second shaft 38 is rotatably mounted within the first shaft 36, which is hollow. The first and second shafts 36,38 are rotatable about an axis 40 of the drum 30.

The features thus far described are disclosed and described in further detail in WO 99/58753. However, in the published document, the means by which the first and second rotatable portions 32,34 of the drum 30 comprise separately driven motors. In the embodiment according to the present invention, the first and second rotatable portions 32 are driven by a single motor 42. This is achieved according to the invention by providing a driving mechanism 50 located on the side of the tub 18 remote from the door 16. The driving mechanism 50 is driven by a drive belt 46 located on a shaft 48 of the motor 42. The driving mechanism 50 consists of a gearbox 60 and an actuator 70. The actuator 70 is mounted on the tub 18 in a manner which will be described below. The gearbox 60 is mounted on the first and second shafts 36,38. As will be described hereinafter, the driving mechanism 50 allows the single motor 42 to drive the first and second rotatable portions 32,34 either in the same direction and at the same speed or in opposite directions at substantially the same speed.

The driving mechanism 50 comprises a gearbox 60 and an actuator 70. The components of the gearbox 60 are shown in exploded form in FIG. 2. For the sake of clarity, the components of the gearbox will be grouped into three groups of components; a first group of components 100, a second group of components 200 and a third group of components 300. Each group of components will now be described in detail.

The first group of components 100 includes a drive wheel 102 which is generally dish shaped. The drive wheel 102 has a generally circular cover plate 104 which has a central aperture 106. Extending axially from the periphery of the cover plate 104 is a cylindrical surface 108. A flange 110 extends radially outwardly from the cylindrical surface 108 on the side thereof remote from the cover plate 104.

The cover plate 104 has three radially extending ribs 112 which are formed integrally therewith. The ribs 112 are equispaced about the central aperture 106. Also, a plurality of holes 114 are equispaced about the central aperture 106 in the vicinity thereof.

The first group of components 100 also incorporates an input gear 116 comprising a set of teeth 118 and a support collar 120. The set of teeth 118 and the support collar 120 are rigidly connected to one another. A bore 122 extends through the input gear 116. Formed in the face of the support collar 120 facing the cover plate 104 are three equiangularly spaced recesses 124 which co-operate with the ribs 112 formed in the cover plate 104. Also, bores 126 extend through the support collar 120 so as to be aligned with the holes 114 formed in the cover plate 104.

The bore 122 formed in the input gear 116 is sufficiently large to receive a sleeve 128 and two axially spaced bearings 130 therein without play. A lip 122*a* extends radially inwardly at the end of the bore 122 remote from the support collar 120. Each of the bearings 130 and the sleeve 128 has an inner bore which is dimensioned so as to receive a distal end of the second shaft 38, also without play. A screw-threaded bolt 132 is provided to co-operate with a screw-threaded bore located in the distal end of the second shaft 38. A washer 134 is provided between the head of the bolt 132 and the side of the bearing 130 closest thereto. The outer diameter of the washer 134 is larger than the inner diameter of the bearing 130 so that, when the input gear 116 is rigidly connected to the drive wheel 102, the sleeve 128 and bearings 130 are held captive in the bore 122 between the lip 122*a* and the washer 134. The central aperture 106 in the cover plate 104 is sufficiently large to allow the head of the bolt 132 and the washer 134 to pass therethrough. A ring-shaped bearing washer 136 is provided on the input gear 116. The ring-shaped bearing washer 136 is dimensioned so that it will fit loosely over the set of teeth 118 but will not project radially beyond the support collar 120.

The first group of components 100 is shown in assembled form in FIGS. 3*a* and 3*b*. As can be seen, the input gear 116 is held securely against the cover plate 104 by means of rivets 138 passing through the holes 114 of the cover plate 104 and into the bores 126 of the support collar 120. The ribs 112 and the recesses 124 co-operate so as to ensure that the input gear 116 is correctly aligned about the axis 40 with respect to the cover plate 104. The distal end of the shaft 38 is thus retained within the bore 122 by means of the bolt 132. However, the bearings 130 allow the drive wheel 102, together with the input gear 116, to rotate freely about the distal end of the shaft 38.

The cylindrical surface 108 of the drive wheel 102 receives the drive belt 46. The flange 110 assists in retaining the drive belt 46 in position on the cylindrical surface 108. The cylindrical surface 108 can have an anti-slip coating or texturing applied thereto in order to reduce the risk of slippage between the drive belt 46 and the drive wheel 102.

The second group of components 200 will now be described. The second group of components 200 includes a first planet carrier plate 202, a second planet carrier plate 204 and a plurality of spacers 206. In the embodiment shown, six spacers 206 are provided. The spacers 206 are equispaced about the axis of the gearbox 60 and are rigidly connected to each of the first and second planet carrier plates 202,204 so as to maintain the first and second planet carrier plates 202,204 spaced apart in the axial direction. The spacers 206 are tubular.

The first planet carrier plate 204 faces the input gear 116. It is generally circular in shape and has a central aperture 208. The central aperture 208 is sufficiently large to allow the set of teeth 118 of the input gear 116 to pass therethrough. A planar portion 210 surrounding the central aperture 208 is radially bounded by a ridge 212 whose inner diameter is slightly larger than the outer diameter of the support collar 120 of the input gear 116. The ring-shaped bearing washer 136 of the first group of components 100 is thus locatable adjacent the planar portion 210. The ridge 212 maintains the ring-shaped washer 136 concentric with the rest of the gearbox 60.

Equispaced about the central aperture 218 are six apertures 214. One end of one of the spacers 206 is cold formed or otherwise rigidly connected to the first planet carrier plate 202 about each of the apertures 214. An inwardly extending lip 216 is formed about each of the apertures 214 so that the diameter of each aperture 214 is slightly less than the diameter of the hollow portion of the respective spacer 206.

The first planet carrier plate 202 is pressed from a suitable metal, e.g. steel. Arcuate shapings 218 are formed therein during manufacture. The purpose of the arcuate shapings 218 will be described below.

The second planet carrier plate 204 is also formed from a suitable metal, e.g. steel. The second planet carrier plate 204 has an annular planar portion 220 having a central aperture 222. Apertures 224 are formed in the planar portion 220 and are equispaced about the central aperture 222. The apertures 224 are axially aligned with the apertures 214 formed in the first planet carrier plate 202. The ends of the spacers 206 remote from the first planet carrier plate 202 are cold formed or otherwise rigidly fixed to the second planet carrier plate 204 about the apertures 224. Thus it can be seen that the spacers 206 act so as to maintain the first and second planet carrier plates 202,204 spaced apart from one another in an axial direction. The fact that the spacers 206 are hollow and located about the apertures 214,224 means that a plurality of passages are provided through the planet carrier assembly consisting of the first planet carrier plate 202, the spacers 206 and the second planet carrier plate 204.

The second planet carrier plate 204 has a flange 226 arranged around the periphery of the central aperture 222 and extending axially towards the first planet carrier plate 202. The second planet carrier plate 204 also has a flange 228 located around the periphery of the planar portion 220, again extending towards the first planet carrier plate 202.

Mounted on alternate spacers 206 and located between the first and second planet carrier plates 202,204 are planet wheels 230. Each planet wheel 230 is freely rotatable about the respective spacer 206 on which it is mounted. To achieve this, each planet wheel 230 is mounted on the respective spacer 206 by way of a bearing 232.

Each planet wheel 230 carries a first set of teeth 234 and a second set of teeth 236 (see FIG. 4). The first set of teeth 234 has a pitch circle which is greater than that of the second set of teeth 236. The first set of teeth 234 is located adjacent the first planet carrier plate 202 and the second set of teeth 236 is located adjacent the second planet carrier plate 204. Each planet wheel 230 is preferably machined as a single part or, if the first and second sets of teeth 234,236 are manufactured separately, they are rigidly connected together during manufacture. A plurality of holes 238 is also preferably machined into each planet wheel 230 in order to reduce the weight thereof.

The positioning of the spacers 206 on which the planet wheels 230 are mounted and the pitch circle of the first set of teeth 234 are chosen so that, when the input gear 116 is introduced through the central aperture 208 of the first planet carrier plate 202, the first set of teeth 118 of the input gear meshes with the first set of teeth 234 of each of the planet wheels 230.

A sun wheel 240 is positioned between the second planet carrier plate 204 and the first sets of teeth 234 of the planet wheels 230. The sun wheel 240 is supported on the second shaft 38 and rotatable therewith. This is achieved by the provision of splines 242 provided in a central aperture in the sun wheel 242 and on the outer surface of the second shaft 38. By positioning of the sun wheel 242 on the second shaft 38 at the point at which the splines are provided, the sun wheel 240 is made rotatable therewith. Again, holes 244 are provided in the sun wheel 240 in order to reduce the weight thereof. The sun wheel 240 carries a set of teeth 246 whose pitch circle diameter is chosen such that the set of teeth 246 meshes with the second set of teeth 236 of the planet wheels 230. A spacer washer 248 is positioned adjacent the sun wheel 242 and on the second shaft 38 on the side of the sun wheel 242 facing the first group of components 100. The spacer washer 248 maintains the sun wheel and the input gear 116 at a fixed distance from one another when the gearbox 60 is assembled.

It will be appreciated that the first and second planet carrier plates 202,204, the spacers 206, the planet wheels 230 and the sun wheel 240 together form an assembly within which the planet wheels 230 are rotatable about their respective spacers 206. The arcuate shapings 218 formed in the first planet carrier plate 202 are provided so as to allow the planet wheels 230 to rotate whilst keeping the spacers 206 as short as possible.

Also included in the second group of components 200 is a locking plate 250. The locking plate 250 is generally planar and is formed from sheet steel. The locking plate 250 is generally circular and has a plurality of equispaced locking fingers 252 extending radially outwardly therefrom. Each locking finger 252 is generally trapezoidal in shape with the longest side radially outermost. Mounted on the locking plate 250 and radially inwardly of the locking fingers 252 are a plurality of tubular legs 254. The number of tubular legs 254 provided on the locking plate 250 corresponds to the number of spacers 206. The tubular legs 254 are positioned on the locking plate 250 so that the tubular legs 254 are aligned with and can pass into the passageways formed by the spacers 206. The tubular legs 254 are punched into or otherwise rigidly fixed to the locking plate 250. Each tubular leg 254 is hollow and has a screw-threaded portion on the internal surface thereof adjacent the locking plate 250. The outer diameter of each tubular leg 254 is sufficiently small to pass through the aperture defined by the lip 216 formed in the first planet carrier plate 202.

A compression spring 256 is located around each tubular leg 254. The diameter of each compression spring 256 is larger than the aperture formed by the respective lip 216. The end of each compression spring 256 facing the first planet carrier plate 202 therefore abuts against the respective lip 216. Bolts 258 having enlarged heads and screw-threaded distal ends are located inside the tubular legs 254 and held in position by means of the screw-threaded portions. Each bolt 258 has an enlarged head which is dimensioned so as to pass freely along the passageway formed within the spacer 206 but against which the end of the compression spring 256 closest to the second planet carrier plate 204 abuts. The compression spring 256 therefore abuts against the lip 216 at one end and against the head of the bolt 258 at the other end. The tubular legs 254 are thus slidably mounted within the spacers 206 so that the locking plate 250 can be displaced with respect to the first and second planet carrier plates 202,204 against the action of the compression springs 256.

A cross section through the second group of components 200 in assembled form is shown in FIG. 4. As can be seen, the locking plate 250 can be displaced in the direction of the arrow 260 against the biasing action of the compression springs 256. The means by which the locking plate 250 can be so displaced will be described below. However, in the absence of any displacing force causing the locking plate 250 to move in the direction of the arrow 260, the locking plate 250 will be biased into the position shown.

The shape of the central aperture 262 of the locking plate 250 corresponds to the form of the arcuate shapings 218 formed in the first planet carrier plate 202. When the locking plate 250 is in the position shown in FIG. 4, i.e. when no displacing force in the direction of arrow 260 is applied, the inwardly extending portions 264 of the central aperture 262 lie between the raised portions 218*a* of the arcuate shapings 218 of the first planet carrier plate 202. This arrangement helps to minimise the axial depth of the gearbox 60 as a whole.

The third group of components 300 simply comprises an annulus 302 and a housing 304. The annulus 302 includes a set of teeth 306 whose pitch circle diameter is chosen so that the first sets of teeth 234 of the planet wheels 230 forming part of the second group of components 200 mesh therewith. The annulus 302 is moulded from a hard engineering thermoplastics material, such as an acetal. An inwardly extending flange 308 is integrally formed with the set of teeth 306 on the side thereof closest to the housing 304. Also integrally formed with the set of teeth 306 and the flange 308 are a plurality of radially outwardly extending projections 310 which are equispaced about the outer surface of the annulus 302. In the embodiment shown, twelve outwardly extending projections 310 are provided.

The housing 304 is generally dish-shaped and has a support plate 312 having a central aperture 314 located therein. The central aperture 314 is sufficiently large to allow the second shaft 38 to pass therethrough. The central aperture 314 has a periphery which includes projecting lugs 316 which assist in the rigid attachment of the first shaft 36 to the support plate 312.

A plurality of locating fingers 318 extend axially from the periphery of the support plate 312. The number of locating fingers 318 corresponds to the number of locking fingers 252 of the locking plate 250. In the embodiment shown, twelve locating fingers are provided. The locating fingers 318 are equispaced about the central aperture 314. The locating fingers 318 are separated by recesses 320 which receive the projections 310 of the annulus 302. When the annulus 302 is seated within the housing 304, the inter-engagement of the projections 310 and the recesses 320 prevent any relative rotation of the annulus 302 with respect to the housing 304.

FIG. 5 shows the housing 304 with the annulus 302 seated therein. As can be seen, the locating fingers 318 project beyond the annulus 302 in the axial direction. Thus, the edge of the assembled third group of components 300 facing the locking plate 250 has a castellated appearance. The locating fingers 318 are dimensioned so that, when the locking plate 250 is pressed towards the first planet carrier plate 202 under the action of the compression springs 256, the locking fingers 252 of the locking plate 250 interleave with the locating fingers 318.

The locking plate 250 has two operative positions, a first position in which the only force applied thereto is the biasing force of the compression springs 256 so that the locking plate is pressed towards the housing 304 and the annulus 302, and a second position in which a displacing force is applied to the locking plate 250 to move it away from the housing 304 and the annulus 302. In the first position, the locking fingers 252 interleave with the locating fingers 318 so as to prevent any relative rotation between the second group of components 200 and the third group of components 300. Any rotation of any one of the second group of components 200 will cause the whole assembly of the first and second groups of components 200,300 to rotate as well. Thus, if the motor 42 drives the drive belt 46 causing the input gear 116 to be rotated, the whole of the gearbox 60 will be rotated in the same direction and at the same speed. The fact that the first shaft 36 is rigidly fixed to the housing 304 and the second shaft 38 is rigidly fixed to the sun wheel 240, means that the first and second shafts 36,38 will also rotate at the same speed and this, in turn, will mean that the first and second rotatable portions 32,34 of the drum 30 will rotate at the same speed and in the same direction. In the second operative position, the locking plate 250 is displaced away from the housing 304 and the annulus 302 (in the direction of the arrow 260 shown in FIG. 4) and the locking fingers 252 become disengaged from the locating fingers 31. At the same time, the locking plate 250 is prevented from rotating with respect to a washing machine 10 (the tub 18) as will be described below. The working components of the gearbox 60 then operate as follows.

It will be understood from the foregoing description that the working components of the gearbox 60 include an annulus 302, three planet wheels 230 and two sun wheels (input gear 116 and sun wheel 240). An exploded view of these components is given in FIG. 6*a*. FIGS. 6*b* and 6*c* are perspective views of the same working components 302, 230,116,240 shown in assembled form and from two different angles. In both cases, all other components have been omitted for clarity.

It will be recalled from the foregoing description that the input gear 116 is rigidly connected to the drive wheel 102 which is driven by the drive belt 46. It will also be recalled that the sun wheel 240 is rigidly connected to the second shaft 38, which carries the second rotatable portion 34 of the drum 30, and that the annulus 302 is rigidly connected (via the housing 304) to the first shaft 36, which carries the first rotatable portion 32 of the drum 30.

When the working components 302,230,116,240 are arranged as shown in FIGS. 6*b* and 6*c* with the locking plate in the second position described above, the input gear 116 is turned as a result of the drive belt 46 causing rotation of the drive wheel 102. The intermeshing of the set of teeth 118 of the input gear with the first sets of teeth 234 of the planet wheels 230 causes the planet wheels 230 to rotate about their respective spacers 206. The first sets of teeth 234 also mesh with the set of teeth 306 of the annulus 302 causing rotation thereof. The planet carrier plates 202,204 are prevented from rotating about the axis 40. The rotation of the planet wheels 230 about their respective spacers 206 inevitably causes rotation of the second sets of teeth 236 of the planet wheels 230 and the intermeshing of these second sets of teeth 236 with the sun wheel 240 causes the sun wheel 240 to rotate. The arrangement ensures that the direction of rotation of the annulus 302 is opposite to that of the sun wheel 240. Thus, if the direction of rotation of the input gear 116 is as indicated by the arrow 62, then the direction of rotation of the annulus 302 is as indicated by the arrow 64 and the direction of rotation of the sun wheel 240 is as indicated by the arrow 66. Hence, when the drive belt 46 is driven by the motor 42, the first shaft 36 and the first rotatable portion 32 are driven in one direction and the second shaft 38 and the second rotatable portion 34 are driven in the opposite direction.

An actuator 70 is provided which is capable of moving the locking plate 252 towards and away from the housing 304. The actuator 70 is shown in exploded form in FIG. 7. It comprises a first actuator ring 72 and a second actuator ring 74. The first actuator ring 72 has a generally ring-shaped body 76 having a flange 78 extending radially outwardly therefrom on a side remote from the second actuator ring 74. The ring-shaped body 76 is planar on the side remote from the second actuator ring 74 but has a plurality of raised portions 80 arranged in the side thereof facing the second actuator ring 74. Each raised portion 80 has an inclined surface 80*a* arranged on either side thereof as shown in FIG. 7. Two raised portions 80 are provided in the embodiment shown. The raised portions 80 are arranged symmetrically about the ring-shaped body 76. It will be appreciated that more than two raised portions 80 can be provided if desired. On one side of the first actuator ring 72 is a radially-projecting lug 82 which carries an arcuate rack of teeth 84 whose purpose will be explained below. A track 81 is provided on the ring-shaped body 76 between the raised portions 80 and the flange 78. A plurality of slots 83 are formed in the ring-shaped body 76 in the radially innermost surface thereof.

The second actuator ring 74 is also generally ring-shaped. The diameter of the second actuator ring corresponds to the diameter of the ring-shaped body 76 of the first actuator ring 72. A plurality of raised portions 86 are arranged about the outer periphery of the second actuator ring 74 and facing the first actuator ring 72. Each of the raised portions 86 has an inclined surface 86*a* arranged on either side thereof in the same manner as that of the raised portions 80. The raised portions 86 are also symmetrically arranged about the second actuator ring 74 and the number of raised portions 86 corresponds to the number of raised portions 80. The inclination of the inclined surfaces 86*a* is the same as that of the inclined surfaces 80*a* so that the inclined surfaces 80*a*,86*a* are able to cooperate with one another to cause the axial spacing of the first and second actuator rings 72,74 to be varied when the first and second actuator rings 72,74 are rotated with respect to one another. A plurality of outwardly extending projections 87 are provided on the second actuator ring 74. The projections 87 are dimensioned and located so that, in a specific rotational orientation of the second actuator ring 74 with respect to the first actuator ring 72, the projections 87 can pass along the slots 83 to a position in which the projections 87 are located beneath the track 81. As soon as the first actuator ring 72 is rotated with respect to the second actuator ring 74, the actuator rings 72,74 are held axially with respect to one another by virtue of the fact that the projections 87 are retained beneath the track 81.

A plurality of locating legs 88 are provided on the second actuating ring 74. The locating legs 88 are arranged radially inwardly of the raised portions 86 and extend in an axial direction away from the gearbox 60. The locating legs 88 can pass through the centre of the first actuator ring 72 and beyond the flange 78. Each locating leg 88 has an axially extending slot 90 therein which is open at the distal end thereof. The purpose of these components will be described and explained below.

The side of the second actuator ring 74 remote from the first actuator ring 72 is shaped so as to included a plurality of shallow depressions 92 symmetrically arranged around the periphery thereof. The number and size of the depressions 92 are selected so that the locking fingers 252 of the locking plate 250 can be received therein.

The actuator 70 also includes a plurality of connectors 94 by means of which the first actuator ring 72 can be attached to the tub 18 of the washing machine 10. Each connector 94 comprises a support portion 94*a* having an aperture extending therethrough and an enlarged head 94*b* located at the end of the support portion 94*a* remote from the tub 18. The head 94*b* is enlarged on one side thereof so that, when the connector is fixedly attached to the tub 18 by means of a self-tapping screw being passed through the aperture and into a bore formed in the tub 18, the enlarged head 94*b* overhangs the flange 78 of the first actuator ring 72. The support portion 94*a* of the connector maintains the head 94*b* at a fixed distance from the tub 18, the distance being slightly more than the thickness of the flange 78, so that the flange 78 is not pressed against the surface of the tub 18, but can slide between the head 94*b* and the surface of the tub 18.

A plurality of connectors 94 are provided, the connectors 94 being spaced about the periphery of the first actuator ring 72. The connectors are located about the axis 40. In this way, the first actuator ring 72 is held captive in a fixed position with respect to the tub 18 whilst being capable of rotational movement about the axis 40. The second actuator ring 74 is then located adjacent the first actuator ring 72 with the locating legs 88 passing through the centre of the first actuator ring 72 and with the raised portions 80, 86 of each actuator ring 72,74 located adjacent one another. The tub 18 is manufactured with a plurality of ribs 18*a* extending radially outwardly from the centre thereof and these ribs 18*a* are received in the slots 90 in the locating legs 88. This arrangement prevents any rotation of the second actuator ring 74 with respect to the tub 18 whilst allowing the second actuator ring 74 to move axially with respect to the tub 18, at least within certain limits. Within those limits, the ribs 18*a* remain within the slots 90 to prevent rotational movement of the second actuator ring 74 with respect to the tub 18. FIG. 8 shows the tub 18 with the second actuator ring 74 in place, the first actuator ring 72 having been omitted for clarity. It will be appreciated that, even if the second actuator ring 74 is displaced in the direction of the arrow 70*a*, rotational movement of the second actuator ring 74 with respect to the tub 18 is prevented.

In order to bring about rotational movement of the first actuator ring 72, a motor 96 carrying a pinion 96*a* is provided. The motor 96 is mounted on a support plate 98 which is fixedly connected to the tub 18. Two switches 98*a*,98*b* are also mounted on the support plate 98, the switches 98*a*,98*b* being spaced from one another along an arcuate path and equidistant from the axis 40. The pinion 96*a* cooperates with the arcuate rack of teeth 84 carried on the lug 82 forming part of the first actuator ring 72. Operation of the motor 96 causes the pinion 96*a* to rotate which, in turn, causes the lug 82 to be moved with respect to the tub 18. The provision and arrangement of the connectors 94 means that this movement of the lug 82 can only result in a rotation of the whole of the first actuator ring 72 about the axis 40. The rotation of the first actuator ring 72 causes the raised portions 80,86 to cooperate so as to move the second actuator ring 74 away from the first actuator ring 72. Also, as the first actuator ring 72 rotates, the lug 82 comes into contact with one or other of the switches 98*a*,98*b*. The switches 98*a*,98*b* are connected to circuitry (not shown) which informs the control processor of the washing machine 10 as to whether or not the gearbox 60 is operating in the manner described above to allow the first and second rotatable portions of the drum to rotate in opposite directions.

FIG. 9*a* is a plan view of the driving mechanism 50 when the first and second actuator rings 72,74 are positioned so that the raised portions 80 are circumferentially spaced from the raised portions 86. Thus the locking plate 250 is biased into the first position in which the locking fingers 252 of the locking plate 250 are interengaged with the locating fingers 318. When the motor 42 is operated, both the first and second rotatable portions 32,34 of the drum 30 are rotated at the same speed and in the same direction. The lug 82 is in contact with the switch 98*a*, which tells the controlling circuitry that the driving mechanism 50 is operating in a manner in which rotation of the input gear 116 results in rotation of both of the first and second rotatable portions 32,34 of the drum 30 at the same speed and in the same direction.

When it is desired to change the mode of operation of the driving mechanism 50, the motor 96 is operated so as to rotate the pinion 96*a*. The first actuator ring 72 is thus rotated about the axis 40 and the second actuator ring 74 then moves axially away from the tub 18. The second actuator ring 74 abuts against the locking plate 250 and the locking fingers 252 of the locking plate 250 become seated in the depressions of the second actuator ring 74. Further movement of the second actuator ring 74 causes the locking fingers 252 to become disengaged from the locating fingers 318 of the housing 304. Rotation of the locking plate 250 about the axis 40 is prevented: hence, rotation of the first and second planet carrier plates 202,204 is also prevented. (It will be understood that, if the locking fingers 252 of the locking plate 250 are not initially aligned with the depressions 92, the second actuator ring 74 will still be moved away in the manner described. The locking fingers 252 will become seated in the depressions 92 as soon as rotation of the locking plate 250 is commenced.) The ribs 18*a* of the tub 18 remain located within the slots 90 of the locating legs of the second actuator ring 74 during the whole of this axial movement. When the movement is complete, the lug 82 contacts the switch 98*b* which informs the controlling circuitry that the driving mechanism 50 is operating in a manner in which rotation of the input gear 116 will result in rotation of the first and second rotatable portions 32,34 of the drum 30 at the same speed but in opposite directions.

FIG. 10*a* is a cross-section through the driving mechanism 50 in the position shown in FIG. 9*a*. The lower half of FIG. 10*a* is taken along the line A—A of FIG. 9*a* and the upper half is taken along the line B—B of FIG. 9*a*. As can be seen, the locking plate 250 is pressed to the left under the action of the compression springs 256 so that the locking fingers 252 are interengaged with the locating fingers 318 of the housing 304. The second actuator ring 74 is spaced axially from the locking plate 250 so as to maintain the locking effect between the second and third groups of components 200,300.

Similarly, FIG. 10*b* is a cross-section through the driving mechanism 50 in the position shown in FIG. 9*b*. The lower half of FIG. 10*b* is taken along the line A—A of FIG. 9*b* and the upper half is taken along the line B—B of FIG. 9*b*. In this position, the second actuator ring 74 maintains the locking plate 250 out of contact with the locating fingers 318 against the action of the compression springs 256 and prevents rotation thereof about the axis 40. The working components 116,230,240,302 are thus able to operate in the manner described above in relation to FIGS. 6*b* and 6*c*.

The washing machine described above can be used in the following manner. Once the articles to be washed have been placed in the interior of the drum 30 via the door 16, the program to be used has been selected and the detergent has been placed in the soap tray 24 (not necessarily in that order), the machine 10 begins to operate a wash/spin cycle.

Water is introduced to the tub 18 via the water inlet conduit 22 and the soap tray 24 so as to introduce water and detergent to the interior of the drum and thus wet the articles. It will be appreciated that the detergent can be introduced to the interior of the drum by other means such as, for example, by placing liquid detergent in a ball inside the drum 30 or by using detergent tablets. Fabric softener can also be used. The details of how the water, detergent and fabric softener are introduced to the interior of the drum are immaterial to the present invention, as are the means of ensuring that the correct amount of water is provided and the manner of increasing the temperature of the water to that required for the wash/spin cycle selected. Such details are well known in the art and will not be described any further here.

Initially, the actuator 70 is positioned so that the first actuator ring 72 is in the position shown in FIG. 9*a*. The locking plate 250 is biased into the first position in which the locking fingers 252 are interengaged with the locating fingers 318 of the housing 304. The lug 82 is in contact with the switch 98*b* which communicates to the controlling circuitry that the locking plate 250 is in the first position. The motor 42 is then driven so that the drive belt 46 causes rotation of the drive wheel 102. This in turn causes the first and second rotatable portions 32,34 of the drum 30 to rotate in the same direction and at the same speed. This synchronised rotation is continued for a short period of time so as to ensure that all of the articles are thoroughly wetted by the water and to commence the washing process. Subsequent periods of synchronised rotation can be carried out if required. Consecutive periods can involve rotating the first and second rotatable portions 32,34 in different directions if desired. To achieve this, the direction of rotation of the motor 42 is reversed after each period has been completed.

When it is required to increase the amount of agitation applied to the articles, the motor 42 is first stopped. The drum 30 thus stops rotating. Next, the motor 96 is operated so as to turn the pinion 96*a* which, in turn, causes the first actuator ring 72 to rotate about the axis 40 of the washing machine 10. The second actuator ring 74 is therefore moved away from the first actuator ring 72 so that the locking plate 250 is displaced in the direction of the arrow 260 in FIG. 4 into the second position. The lug 82 also contacts the switch 98*a* so as to communicate to the contolling circuitry that counter rotation will commence if the motor is operated. The motor 42 is then operated again so that the first and second rotatable portions 32,34 of the drum 30 rotate in opposite directions and at substantially the same speed. This allows a high rate of agitation to be applied to the articles. The speed of rotation of each rotatable portion 32,34 in this mode is less than 100 rpm, commonly around 50 rpm, but will not normally be higher than 200 rpm.

When sufficient agitation has been applied to the articles to achieve the standard of cleaning required by the selected program, the motor 42 is stopped. The motor 96 is operated again so as to return the first actuator ring 72 to the position shown in FIG. 9*a* which, in turn, causes the locking plate 250 to return to the first position. Subsequent operation of the motor 42 thus causes synchronised rotation of the first and second rotatable portions 32,34 as has already been described. In this mode, the washing water and detergent can be drained out of the tub 18 through the drainage outlet 28 via the water drainage conduit 26. Rinse water is then introduced to the tub 18 in a known manner and the speed of rotation of the drum 30 is then increased to a spin speed (commonly 800–1500 rpm) in order to spin the rinse water out of the articles. The rinse and spin steps are repeated 3 or 4 times. Spin cycles of this type are well known and need not be described any further here.

The foregoing description relates to only one embodiment of the invention. It will be understood that variations to the described embodiment can be made without departing from the scope of the invention. For example, other types of gearwheel can be used in place of the ones illustrated in the drawings. Also, any form of locking mechanism can be employed as long as the effect is that, in one position, rotation of the input gear causes both of the output gears to rotate in the same direction, and, in another position, rotation of the input gear causes the output gears to rotate in opposite directions. The interengagement or interleaving of a set of locking fingers with a set of locating fingers is not the only way of achieving this and other methods could be used. For example, the second planet carrier could carry retractable locking pins which could be extended to lock the second planet carrier plate to the housing and retracted to allow relative rotation therebetween. In another alternative arrangement, the locking plate could carry movable pins which could be moved into the weight-reducing holes formed in the planet wheels. Other methods and mechanisms for achieving a similar locking effect will be apparent to a skilled reader. In a further variation to the embodiment described above, the axis 40 of the washing machine 10 about which the rotatable portions 32, 34 of the drum 30 rotate is arranged so as to be inclined slightly to the horizontal, rather than precisely horizontal. The angle of inclination to the horizontal is unlikely to be greater than 15° because an angle much greater than this may affect the wash action achievable by the wash action described above. Nevertheless, the term "substantially horizontal" as used in the claims appended hereto is intended to include axes inclined at an angle of up to 15° to the horizontal.

The invention claimed is:

1. An appliance comprising two rotatable portions and a driving mechanism for rotating the rotatable portions about a horizontal or substantially horizontal axis of rotation, the driving mechanism comprising a gearbox having an input gear, two output gears separate from the input gear each connected to respective rotatable portions and a locking mechanism movable between a first position and a second position, the arrangement of the input gear, the output gears and the locking mechanism being such that, when the locking mechanism is in the first position and the input gear is driven, the output gears each drive their respective rotatable portions to rotate in the same direction and, when the locking mechanism is in the second position and the input gear is driven, the output gears each drive their respective rotatable portions to rotate in opposite directions wherein the rotatable portions are portions of a cylindrical drum.

2. An appliance as claimed in claim 1, wherein the output gears are coaxial.

3. An appliance as claimed in claim 2, wherein the input gear is coaxial with the output gears.

4. An appliance as claimed in claim 2, wherein each output gear is rigidly connected to a shaft, one of the said shafts being rotatably arranged inside the other of the said shafts.

5. An appliance as claimed in claim 1, wherein, when the locking mechanism is in the first position and the input gear is driven, the driving mechanism is configured so that both output gears rotate in the same direction and at the same speed.

6. An appliance as claimed in claim 1, wherein, when the locking mechanism is in the second position and the input gear is driven, the output gears rotate in opposite directions at substantially the same speed.

7. An appliance as claimed in claim 1, wherein the gearbox comprises a gear arrangement having an annulus, a plurality of planet wheels carried on a planet carrier, and two sun wheels.

8. An appliance as claimed in claim 7, wherein a first of the sun wheels comprises the input gear and a second of the sun wheels and the annulus comprise the output gears.

9. An appliance as claimed in claim 7, wherein, when the locking mechanism is in the first position, the locking mechanism engages both the planet carrier and the annulus so as to prevent relative rotation therebetween.

10. An appliance as claimed in claim 9, wherein the locking mechanism and the annulus each carry a plurality of projections, the projections carried by the locking mechanism interengaging with the projections carried by the annulus when the locking mechanism is in the first position.

11. An appliance as claimed in claim 10, wherein the number of projections carried by the annulus is the same as the number of projections carried by the locking mechanism.

12. An appliance as claimed in claim 10, wherein the projections carried by the locking mechanism extend in a radial direction away from the axis of the gearbox.

13. An appliance as claimed in claim 10, wherein the projections carried by the annulus extend in an axial direction parallel to the axis of the gearbox.

14. An appliance as claimed in claim 7, wherein the locking mechanism is mounted on the planet carrier.

15. An appliance as claimed in claim 14, wherein the locking mechanism comprises a locking plate which is mounted so as to be slidably movable, with respect to the planet carrier, in the direction of the axis of the gearbox between the first position and the second position.

16. An appliance as claimed in claim 15, wherein the locking plate is biased into the first position by a biasing device.

17. An appliance as claimed in claim 16, wherein the biasing device comprises compression springs.

18. An appliance as claimed in claim 16, further comprising an actuator provided to move the locking plate from the first position to the second position against the action of the biasing device.

19. An appliance as claimed in claim 18, wherein actuation of the actuator causes movement of the locking plate in a direction parallel to the axis of the gearbox.

20. An appliance as claimed in claim 18, wherein the actuator is attached to a fixed portion of the appliance.

21. An appliance as claimed in claim 20, wherein the actuator comprises a first actuator ring and a second actuator ring, the first actuator ring being attached to the fixed portion of the appliance in a manner which allows rotation thereof about the axis of the gearbox and having inclined surfaces facing the second actuator ring, the second actuator ring being engaged with the fixed portion of the appliance in a manner which allows movement thereof parallel to the axis of the gearbox and having inclined surfaces facing the first actuator ring and complementary to the inclined surfaces of the first actuator ring, such that rotational movement of the first actuator ring causes movement of the second actuator ring parallel to the axis of the gearbox as a result of the movement of the inclined surfaces across one another.

22. An appliance as claimed in claim 21, further comprising a device for rotating the first actuator ring about the axis of the gearbox.

23. An appliance as claimed in claim 22, wherein the device for rotating the first actuator ring about the axis of the gearbox comprises a motor carrying a pinion and a rack attached to the first actuator ring, the motor being mounted on the fixed portion of the appliance.

24. An appliance as claimed in claim 20, wherein, when the locking mechanism is in the second position, the locking plate is rotationally fixed with respect to the fixed portion of the appliance.

25. An appliance as claimed in claim 1, wherein the drum is mounted inside a tub.

26. An appliance as claimed in claim 1, wherein the driving mechanism is mounted adjacent the drum.

27. An appliance as claimed in claim 1, wherein the appliance is a washing machine.

28. A method of operating an appliance comprising two rotatable portions and a driving mechanism for rotating the rotatable portions about a horizontal or substantially horizontal axis of rotation, the driving mechanism comprising a gearbox having an input gear, two output gears separate from the input gear each connected to respective rotatable portions and a locking mechanism movable between a first position and a second position, the arrangement of the input gear, the output gears and the locking mechanism being such that, when the locking mechanism is in the first position and the input gear is driven, the output gears each drive their respective rotatable portions to rotate in the same direction and, when the locking mechanism is in the second position and the input gear is driven, the output gears each drive their respective rotatable portions to rotate in opposite directions, wherein the rotatable portions are portions of a cylindrical drum, the method comprising:

(a) driving the input gear with the locking mechanism in the first position so as to drive the output gears, and thus the respective rotatable portions, to rotate in the same direction;

(b) causing the locking mechanism to move from the first position to the second position; and (c) driving the input gear with the locking mechanism in the second position so as to drive the output gears, and thus the respective rotatable portions, to rotate in opposite directions.

29. A method as claimed in claim 28, wherein, after step (c), the locking mechanism is moved from the second position to the first position and step (a) is repeated.

30. A method as claimed in claim 28, wherein, during step (a), the drive to the input gear is applied consecutively in opposite directions.

31. A method as claimed in claim 28, wherein, during step (c), the output gears rotate in opposite directions at substantially the same rotational speed.

32. A method as claimed in claim 28, wherein, during step (c), neither of the output gears rotates at a rotational speed of more than 200 rpm.

* * * * *